US008146961B2

(12) United States Patent
Schacht

(10) Patent No.: US 8,146,961 B2
(45) Date of Patent: Apr. 3, 2012

(54) EXIT DEVICE

(75) Inventor: David M. Schacht, New Castle, IN (US)

(73) Assignee: Von Duprin, Inc., Indianapolis, IN (US)

( * ) Notice: Subject to any disclaimer, the term of this patent is extended or adjusted under 35 U.S.C. 154(b) by 938 days.

(21) Appl. No.: 12/169,388

(22) Filed: Jul. 8, 2008

(65) Prior Publication Data

US 2010/0007154 A1 Jan. 14, 2010

(51) Int. Cl.
*E05B 65/10* (2006.01)

(52) U.S. Cl. ..... 292/92; 292/DIG. 65

(58) Field of Classification Search ..... 292/92, 292/93, DIG. 65; 70/92
See application file for complete search history.

(56) References Cited

U.S. PATENT DOCUMENTS

| | | | |
|---|---|---|---|
| 3,705,739 | A | 12/1972 | Adler |
| 3,744,832 | A | 7/1973 | Casey et al. |
| 3,777,422 | A | 12/1973 | Janssen |
| 3,811,717 | A | 5/1974 | Floyd et al. |
| 4,005,886 | A | 2/1977 | Lirette |
| 4,007,954 | A | 2/1977 | Erickson |
| 4,015,869 | A | 4/1977 | Horvath |
| 4,099,753 | A | 7/1978 | Gwozdz et al. |
| 4,145,900 | A | 3/1979 | Ohno |
| 4,161,804 | A | 7/1979 | D'Hooge et al. |
| 4,183,565 | A | 1/1980 | Allemann |
| RE30,263 | E | 4/1980 | Horvath |
| 4,272,111 | A | 6/1981 | Hammer et al. |
| 4,311,329 | A | 1/1982 | Kral |
| 4,333,489 | A | 6/1982 | Magill et al. |
| 4,437,693 | A | 3/1984 | Godec |
| 4,453,753 | A | 6/1984 | Fayerman et al. |
| 4,502,720 | A | 3/1985 | Fayerman et al. |
| 4,598,939 | A | 7/1986 | Krupicka et al. |
| 4,709,950 | A | 12/1987 | Zortman |
| 4,714,285 | A | 12/1987 | Langham |
| 4,726,613 | A | 2/1988 | Foshee |
| 4,747,629 | A | 5/1988 | Miller |
| 4,824,150 | A | 4/1989 | Smith et al. |
| 4,865,367 | A | 9/1989 | Choi |
| 4,884,832 | A | 12/1989 | Bungard |
| 4,986,583 | A | 1/1991 | Campbell et al. |
| 5,022,690 | A | 6/1991 | Coltrin et al. |
| 5,121,950 | A | 6/1992 | Davidian |
| 5,245,879 | A | 9/1993 | McKeon |
| 5,380,053 | A | 1/1995 | Saino |
| 5,427,420 | A | 6/1995 | Moore |
| 5,464,259 | A | 11/1995 | Cohrs et al. |
| 5,492,208 | A | 2/1996 | Goossens |
| 5,527,074 | A | 6/1996 | Yeh |
| 5,588,686 | A | 12/1996 | Riley et al. |
| 5,619,824 | A | 4/1997 | Russell et al. |

(Continued)

*Primary Examiner* — Gary Estremsky
(74) *Attorney, Agent, or Firm* — Michael Best & Friedrich LLP

(57) ABSTRACT

An exit device includes a housing, a latchbolt coupled to and movable relative to the housing, and an auxiliary bolt coupled to the housing and movable relative to the latchbolt. The exit device also includes a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing. The exit device further includes a spring biasing the auxiliary bolt into engagement with a portion of the deadlock link to move the deadlock link toward the first position.

24 Claims, 11 Drawing Sheets

U.S. PATENT DOCUMENTS 5,638,639 A 6/1997 Goodman et al.
5,673,949 A 10/1997 Mader et al.
5,688,002 A 11/1997 Riley et al.
5,690,371 A 11/1997 Turnbull
5,782,509 A 7/1998 Uyeda
5,839,766 A 11/1998 Iannuzzi et al.
5,864,936 A 2/1999 Riley et al.
5,890,752 A 4/1999 Lin
6,009,732 A 1/2000 Haeck et al.
6,106,032 A 8/2000 Och
6,131,338 A 10/2000 Haeck et al.
6,205,825 B1 * 3/2001 Haeck et al. ..... 70/92
6,283,513 B1 9/2001 Yeh
6,532,777 B2 3/2003 Haeck et al.
6,581,423 B2 6/2003 Lin
6,615,544 B1 9/2003 Tlemcani et al.
6,725,602 B1 4/2004 McWilliams
6,820,905 B1 11/2004 Haeck et al.
6,854,773 B2 2/2005 Lin
6,886,871 B1 5/2005 Shen
7,028,431 B2 4/2006 Tlemcani et al.
7,044,510 B2 5/2006 Lin
7,070,210 B2 * 7/2006 Lin ..... 292/93

* cited by examiner

EXIT DEVICE

BACKGROUND

The present invention relates to exit devices.

Exit devices are commonly mounted on doors in large facilities or public buildings to hold the doors in closed positions while permitting easy egress. Typically, an exit device includes a latchbolt movably coupled to a door to engage a strike, an auxiliary bolt coupled to the latchbolt to also engage the strike, and a deadlock link positioned to prevent retraction of the latchbolt when the door is closed. Exit devices also typically include a pushbar that can be depressed to move the deadlock link to an unlocked position, allowing the latchbolt to retract such that a user can open the door. Separate springs are usually employed to individually bias the auxiliary bolt to an extended position and the deadlock link to a locked position.

SUMMARY

In one embodiment, the invention provides an exit device including a housing, a latchbolt coupled to and movable relative to the housing, and an auxiliary bolt coupled to the housing and movable relative to the latchbolt. The exit device also includes a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing. The exit device further includes a spring biasing the auxiliary bolt into engagement with a portion of the deadlock link to move the deadlock link toward the first position.

In another embodiment, the invention provides an exit device including a housing, a latchbolt coupled to and movable relative to the housing, and an auxiliary bolt coupled to the housing and movable relative to the latchbolt. The exit device also includes a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing. The exit device further includes a bracket engaging a portion of the deadlock link to move the deadlock toward the second position. The bracket is configured to melt at relatively high temperatures. The exit device also includes a firedog link supported by the bracket such that, when the bracket melts, the firedog link moves relative to the deadlock link to inhibit movement of the deadlock link from the second position to the first position.

In yet another embodiment, the invention provides an exit device including a housing, a latchbolt coupled to and movable relative to the housing, and a pushbar coupled to the latchbolt. The pushbar is actuable to move the latchbolt to a retracted position relative to the housing. The exit device also includes an auxiliary bolt coupled to the housing and movable relative to the latchbolt and a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing. The exit device further includes a bracket coupled to the auxiliary bolt and the deadlock link. The bracket is configured to melt at relatively high temperatures. The exit device also includes a spring positioned between the auxiliary bolt and the bracket. The spring biases the auxiliary bolt into engagement with a portion of the deadlock link to move the deadlock link toward the first position and biases the bracket into engagement with another portion of the deadlock link to move the deadlock link toward the second position. The exit device further includes a firedog link supported by the bracket such that, when the bracket melts, the firedog link moves relative to the deadlock link to inhibit movement of the deadlock link from the second position to the first position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
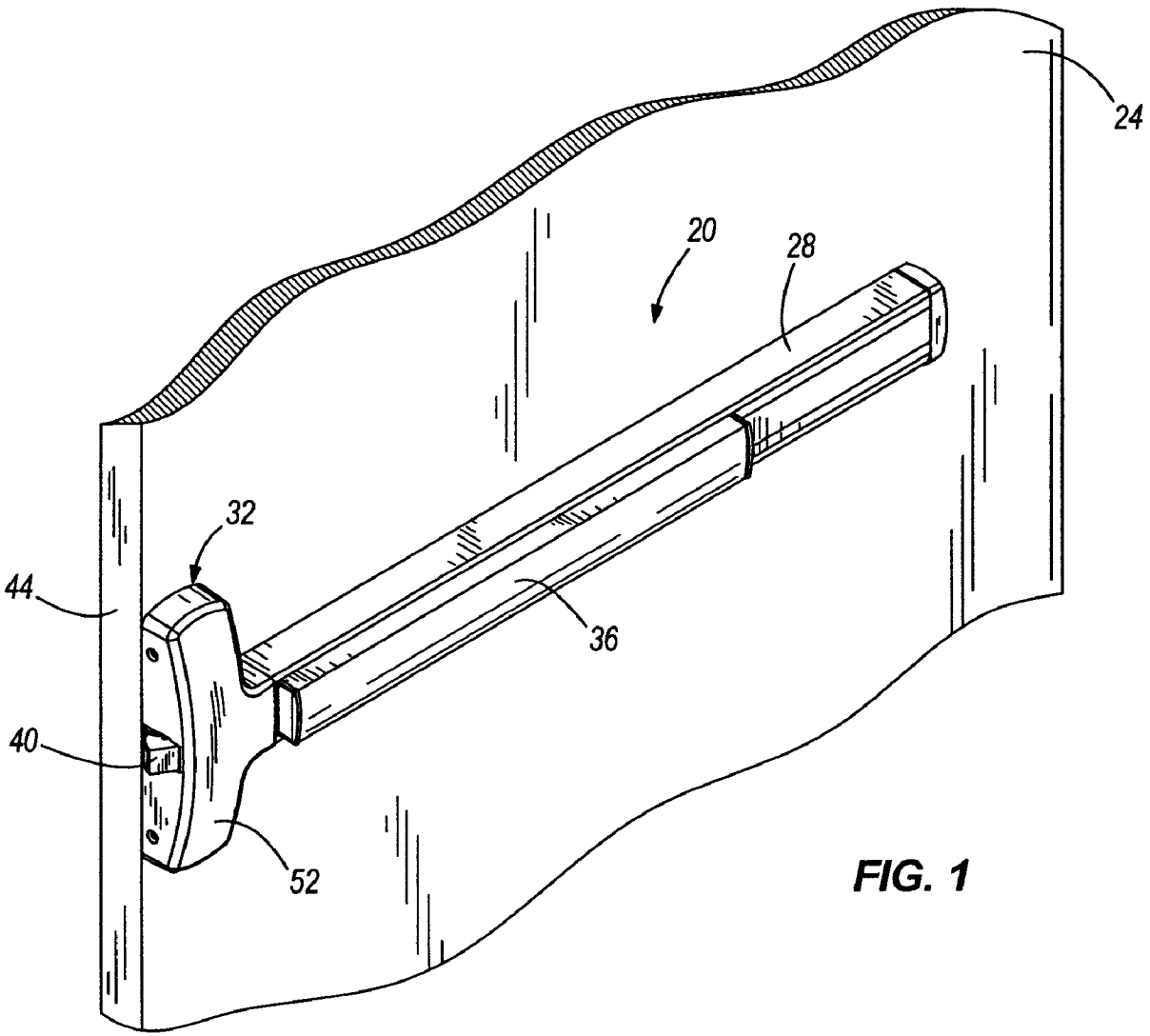
FIG. 1 is a perspective view of a door and an exit device embodying the invention.

FIG. 1 illustrates an exit device 20 embodying the invention. The exit device 20 is mounted to a door 24 in, for example, an office building, school, warehouse, factory, or other public building. In the illustrated construction, the exit device 20 and all of its internal components are substantially symmetrical about a central plane extending through the device 20 such that the exit device 20 may be reversed (e.g., rotated 180 degrees) to mount adjacent to either edge or on either side of the door 24.

The illustrated exit device 20 includes an elongated housing 28, a head mechanism 32, and a pushbar 36. The elongated housing 28, or channel, is mounted to the door 24 and supports the pushbar 36. The head mechanism 32 is mounted to the door 24 adjacent to the elongated housing 28 and includes a latchbolt 40 extending beyond an edge 44 of the door 24. In the illustrated construction, the latchbolt 40 is configured to engage a strike 48 (FIGS. 4 and 6-8) when in an extended position (FIGS. 2-7) to retain the door 24 in a closed position. The pushbar 36 is coupled to the head mechanism 32 through the elongated housing 28 to actuate the latchbolt 40 from the extended position to a retracted position (FIG. 8) such that the latchbolt 40 disengages the strike 48, allowing the door 24 to be pushed open. In some constructions, the pushbar 36 may be coupled to the head mechanism 32 and actuate the latchbolt 40 with, for example, a crank-rocker mechanism or a scissor mechanism positioned within the elongated housing 28. In other constructions, other suitable actuators (e.g., a rotatable handle or lever, or the like) may be coupled to the head mechanism 32 to actuate the latchbolt 40. Such arrangements are known in the art.

Figure 2:
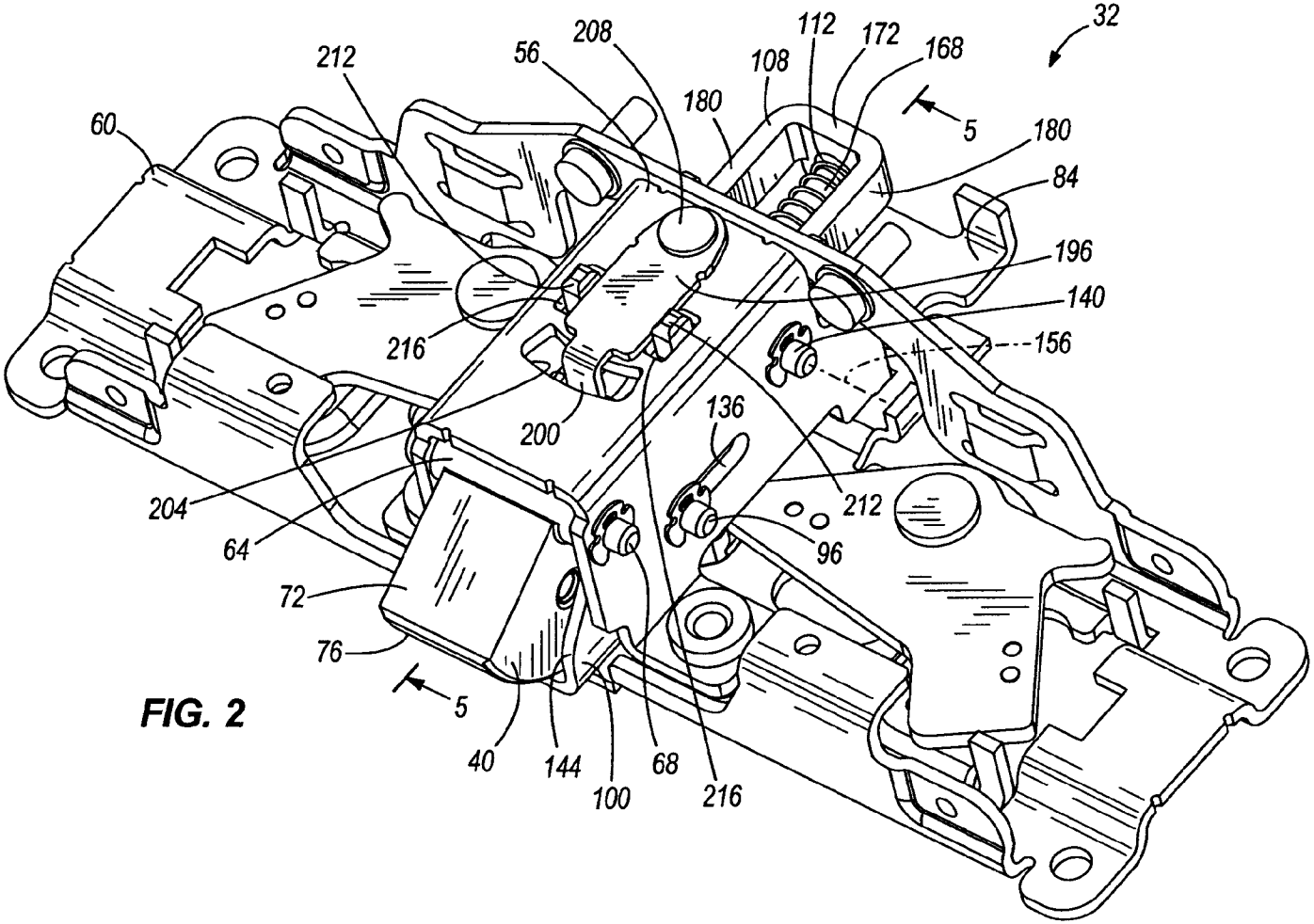
FIG. 2 is a perspective view of a head mechanism of the exit device shown in FIG. 1 without an outer cover.
Figure 3:
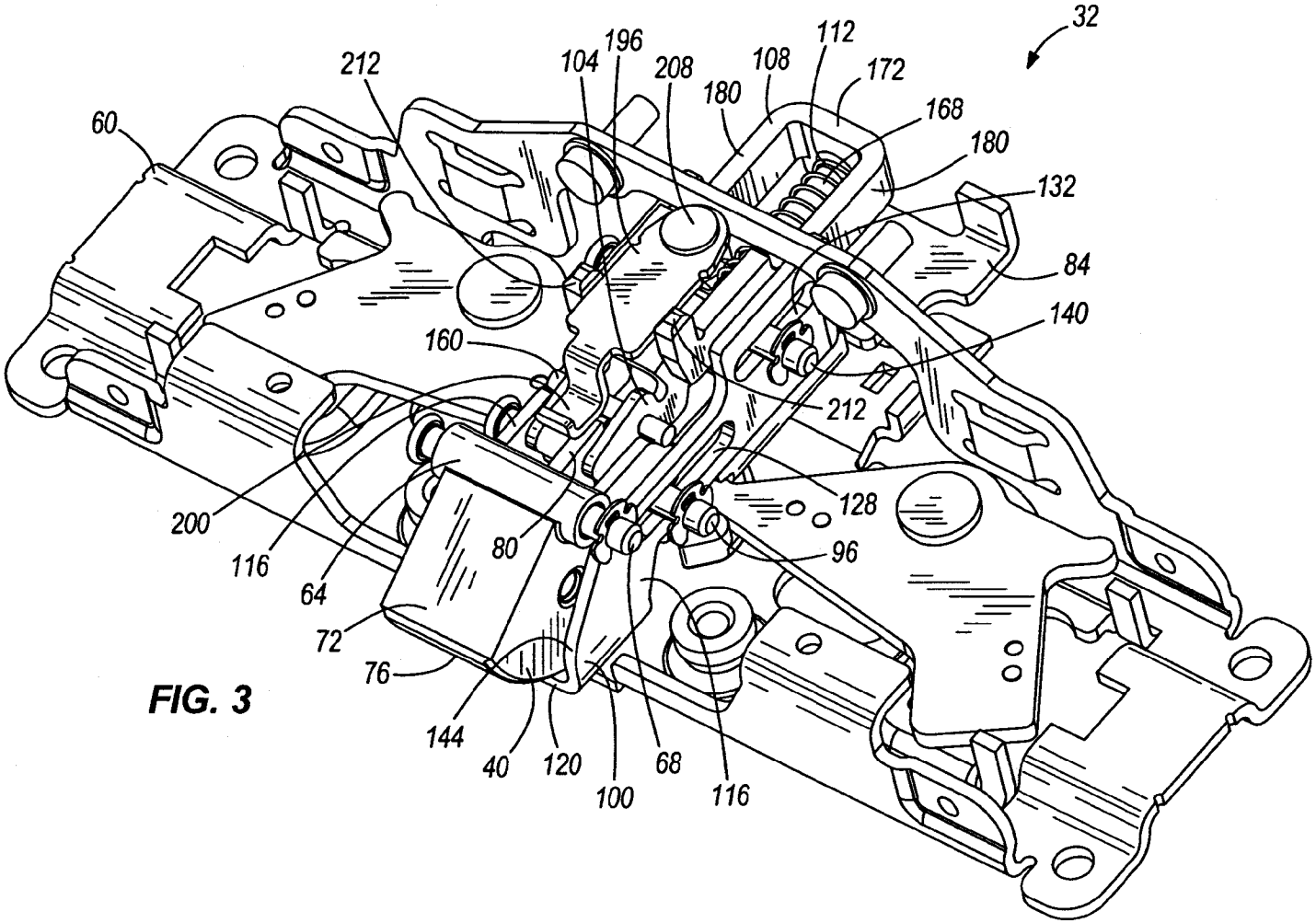
FIG. 3 is a perspective view of the head mechanism shown in FIG. 2 without an inner housing.

FIGS. 2 and 3 illustrate the head mechanism 32 of the exit device 20 in more detail. In the illustrated construction, the head mechanism 32 includes an outer cover 52 (FIG. 1), an inner housing 56, and the latchbolt 40. The outer cover 52 is coupled to a chassis 60 of the head mechanism 32 to cover and protect the internal components of the head mechanism 32. The inner housing 56 is coupled to the chassis 60 within the outer cover 52 to support the latchbolt 40 and other internal components of the head mechanism 32. The outer cover 52 is removed from the head mechanism 32 in FIGS. 2 and 3 and the inner housing 56 is removed from the head mechanism 32 in FIG. 3 to facilitate illustration of the internal components of the head mechanism 32.

The illustrated latchbolt 40 is coupled to the inner housing 56 and extends from the outer cover 52 adjacent to the edge 44 of the door 24. As shown in FIG. 2, the latchbolt 40 includes a bearing 64 surrounding a portion of a pin 68. The pin 68 extends through the inner housing 56 such that the latchbolt 40 rotates about the pin 68 relative to the inner housing 56 between the extended position (FIGS. 2-7) and the retracted position (FIG. 8). A biasing member (e.g., a torsional spring) is positioned within the latchbolt 40 about a pin 92 to bias the latchbolt 40 toward the extended position.

Figure 4:
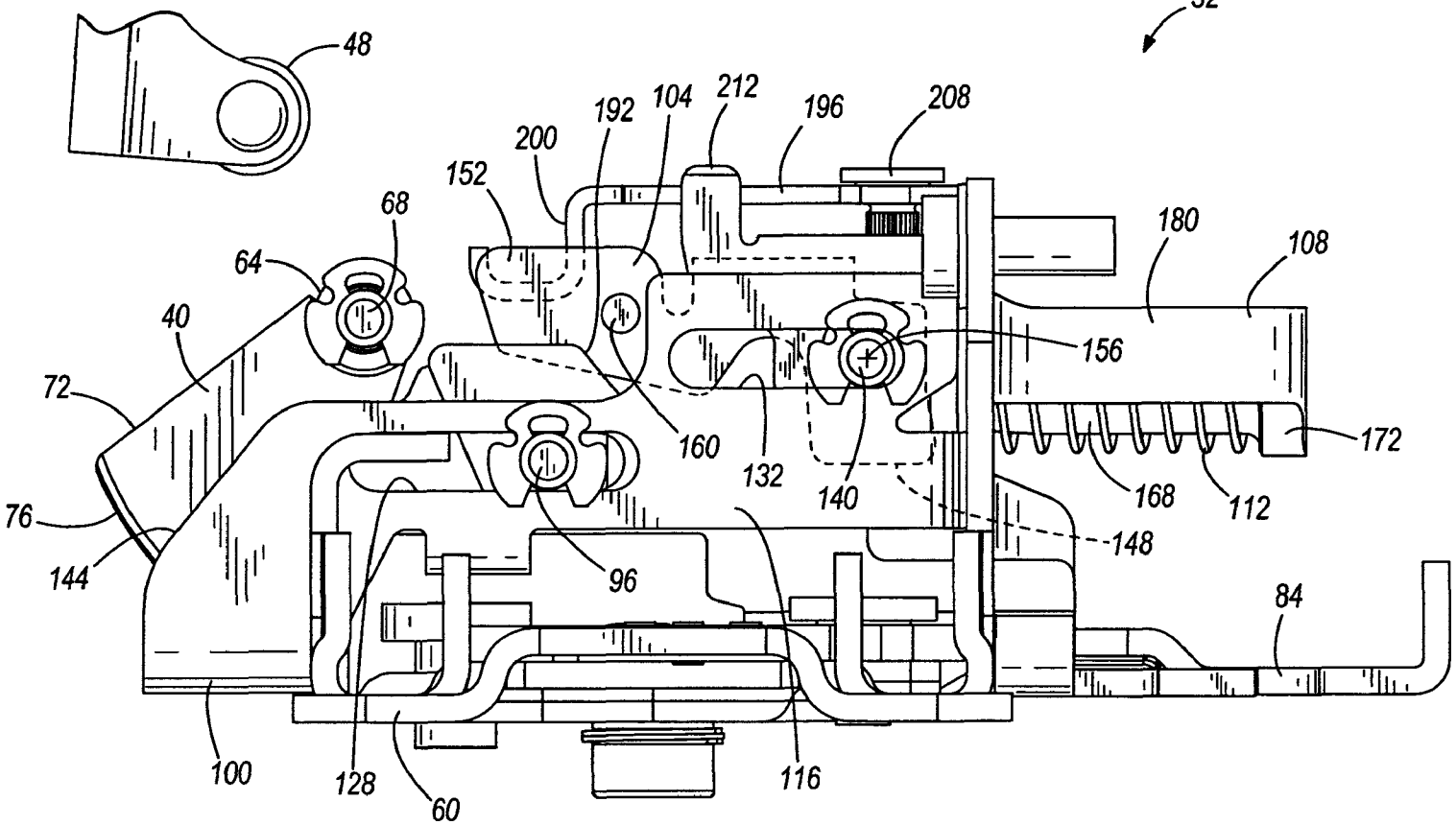
FIG. 4 is a bottom view of the head mechanism shown in FIG. 3 when the door is in an open position.
Figure 5:
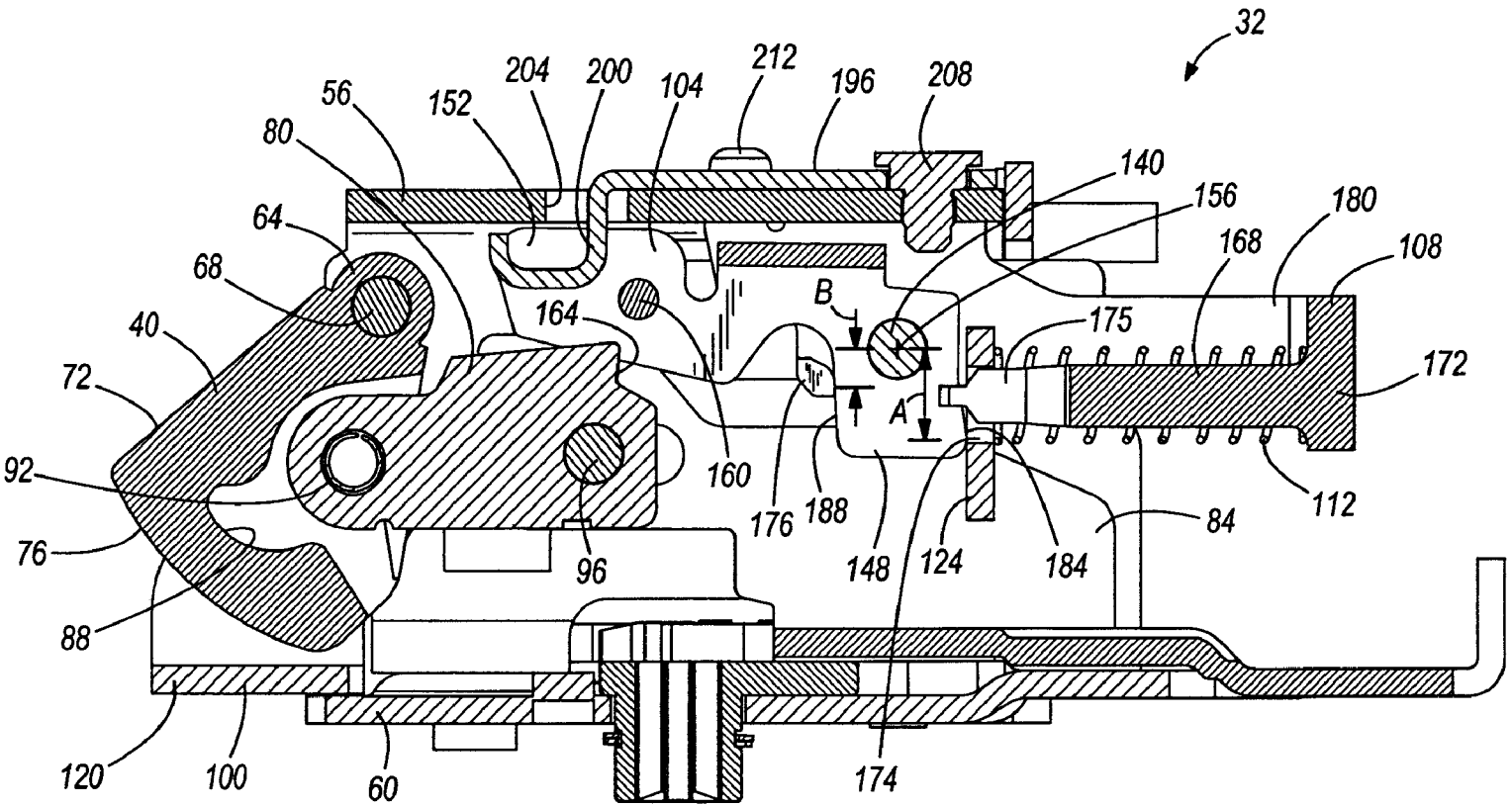
FIG. 5 is a cross-sectional view of the head mechanism taken along section line 5-5 of FIG. 2 when the door is in the open position.
Figure 6:
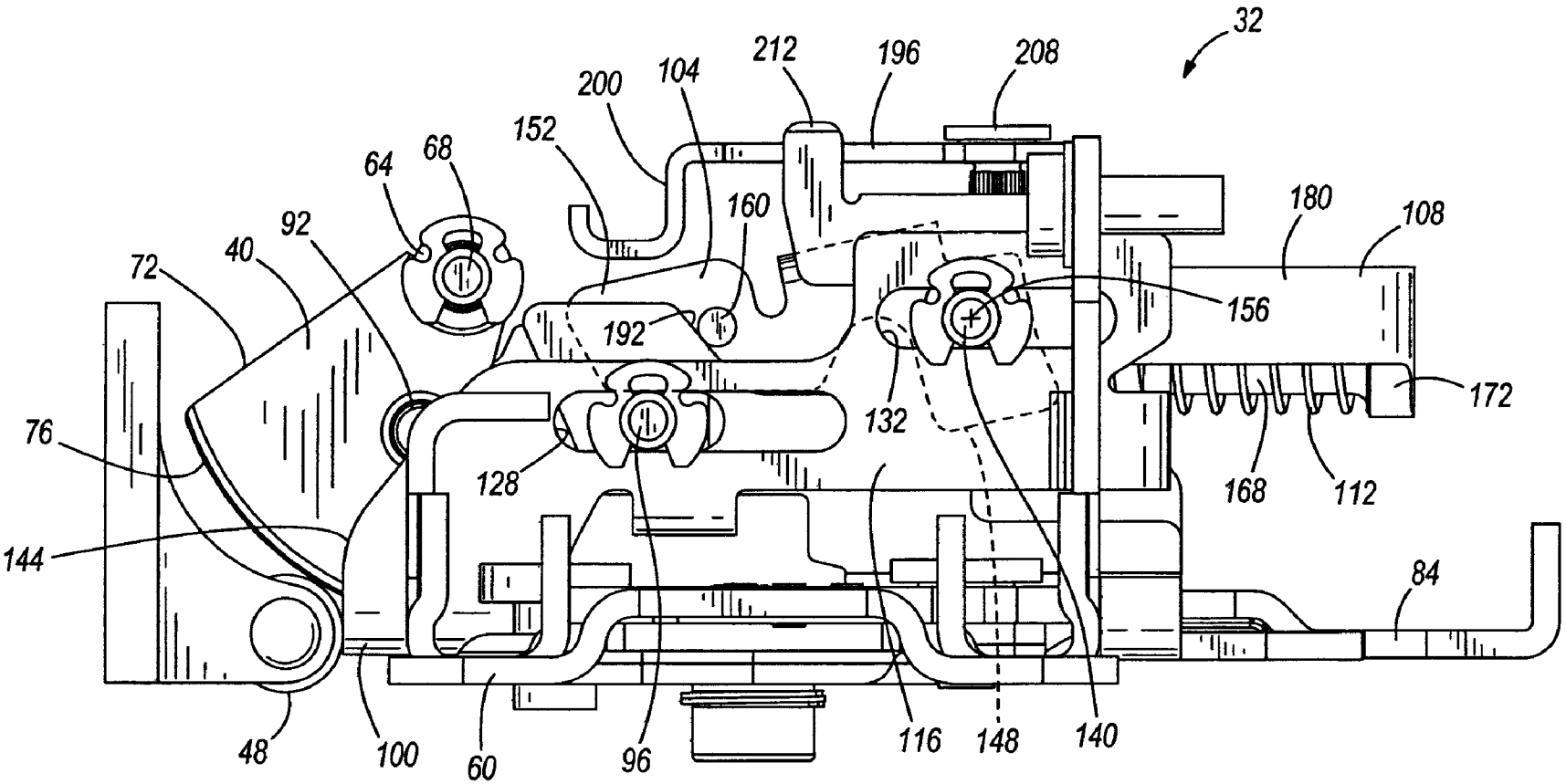
FIG. 6 is a bottom view of the head mechanism shown in FIG. 3 when the door is in a closed position.

As shown in FIGS. 4-8, the latchbolt 40 also includes a generally planar surface 72 and a curved surface 76. When the door is closing, the strike 48 engages the planar surface 72 to push latchbolt 40 against the bias of the biasing member, rotating the latchbolt 40 about the pin 68 to the retracted position. The latchbolt 40 is thereby moved out of the way (i.e., clears) the strike 48 so that the door 24 can finish rotating to the closed position. Referring to FIGS. 6 and 8, once the door 24 is in the closed position, the biasing member biases the latchbolt 40 back to the extended position. In the extended position, the curved surface 76 of the latchbolt 40 engages the strike 48 to retain the door 24 in the closed position.

Figure 7:
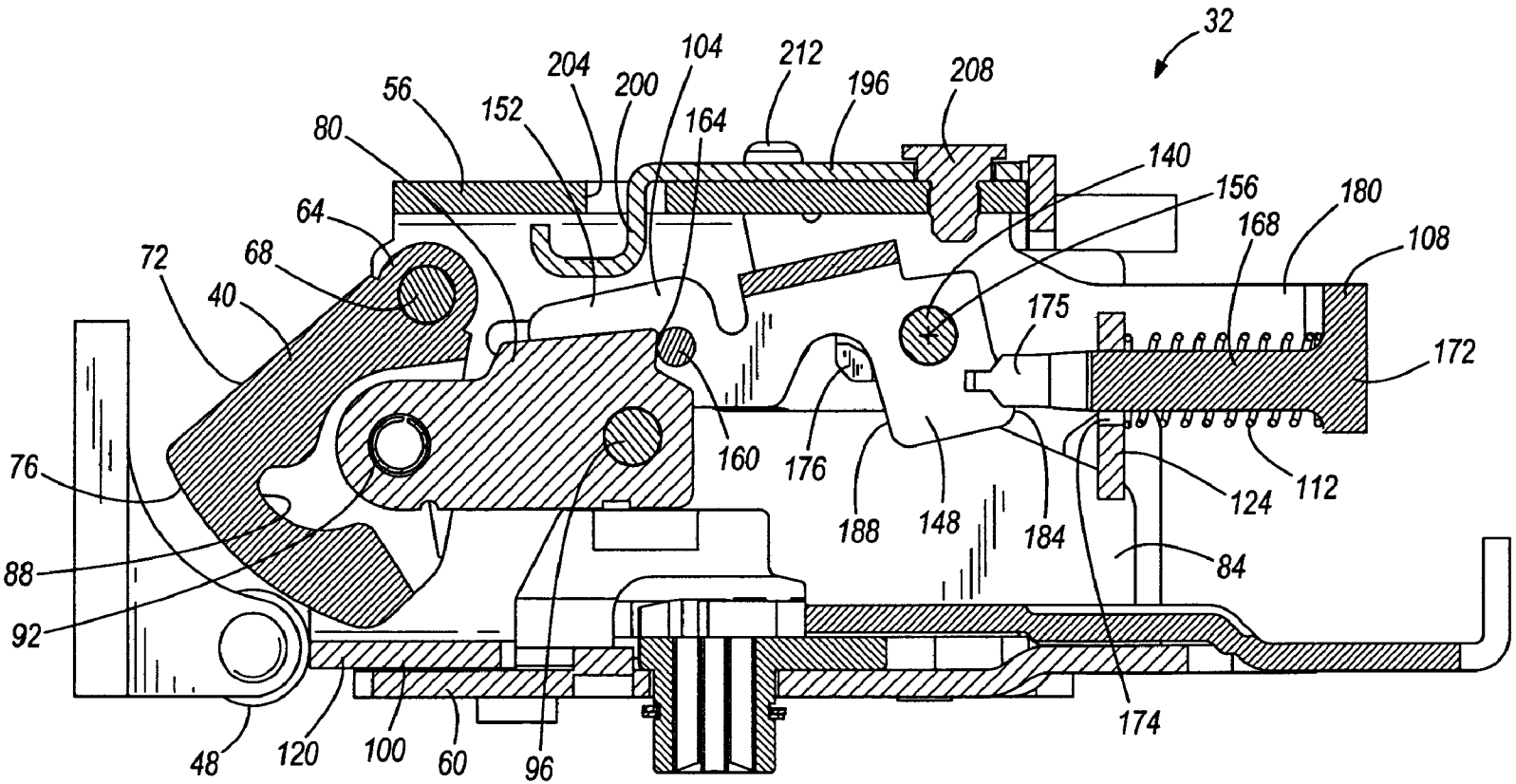
FIG. 7 is a cross-sectional view of the head mechanism taken along section line 5-5 of FIG. 2 when the door is in the closed position.
Figure 8:
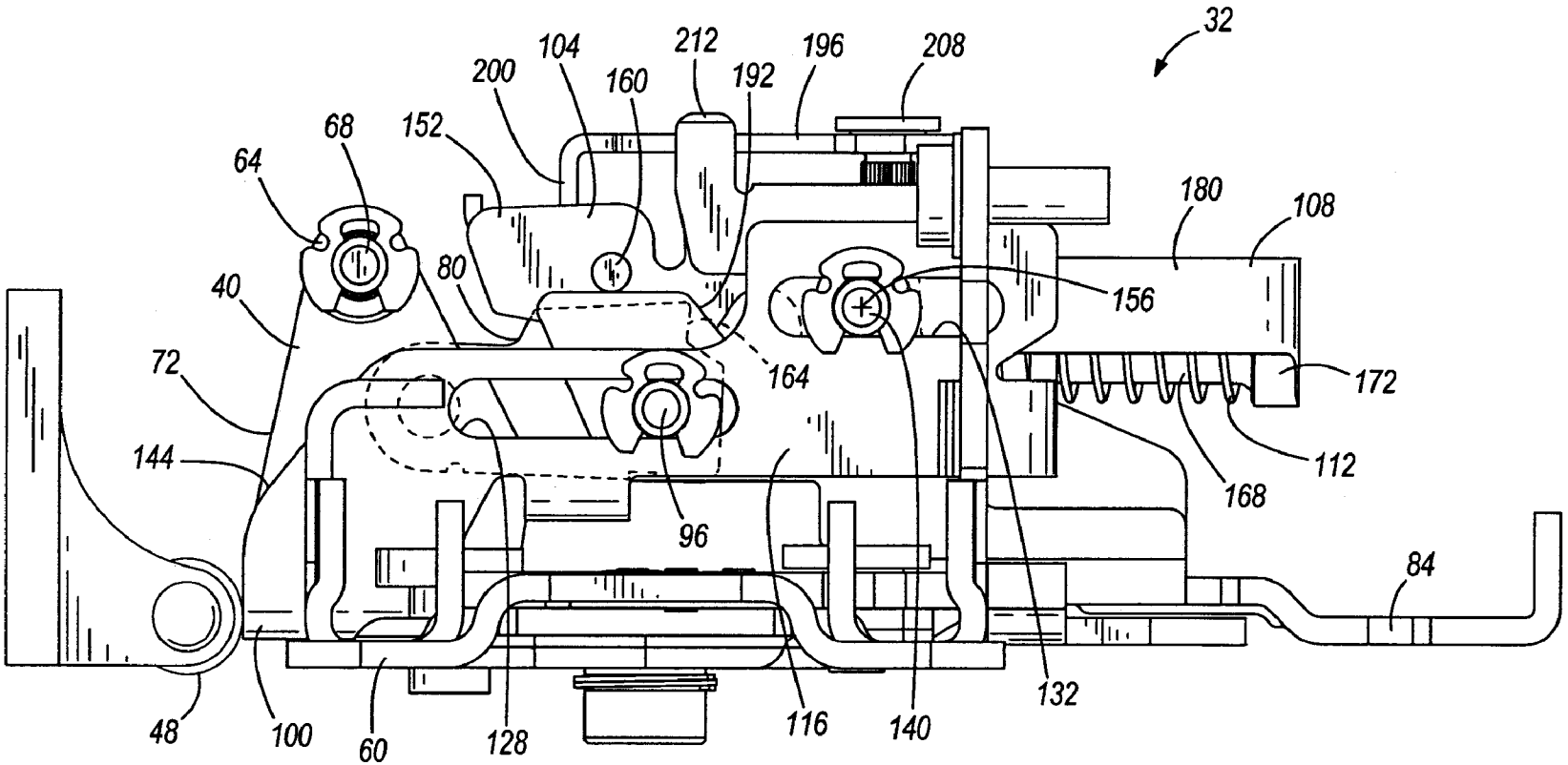
FIG. 8 is a bottom view of the head mechanism shown in FIG. 3 when the door is in the closed position and a latchbolt of the head mechanism is in a retracted position.

As shown in FIGS. 5 and 7, the head mechanism 32 includes a latchbolt link 80 and a pushbar link 84. An end portion of the latchbolt link 80 is positioned within a cavity 88 of the latchbolt 40 and supports the hollow pin 92 to couple the latchbolt link 80 to the latchbolt 40. The hollow pin 92 allows some relative movement (e.g., rotation) between the latchbolt 40 and the latchbolt link 80 as the latchbolt 40 rotates about the pin 68. The opposite end of the latchbolt link 80 is coupled to the pushbar link 84 with a pin 96. The pushbar link 84 is in turn coupled to the pushbar 36 (FIG. 1) such that actuating (e.g., depressing) the pushbar 36 pulls the pushbar link 84 away from the latchbolt 40. As shown in FIG. 8, moving the pushbar link 84 away from the latchbolt 40 pulls the latchbolt link 80 and the latchbolt 40, rotating the latchbolt 40 about the pin 68 from the extended position to the retracted position. When the latchbolt 40 is in the retracted position, the planar and curved surfaces 72, 76 of the latchbolt 40 are moved out of engagement with the strike 48 such that a user may rotate the door 24 to the open position.

Referring to FIG. 3, the head mechanism 32 also includes an auxiliary bolt 100, a deadlock link 104, a bracket 108, and a spring 112. The illustrated auxiliary bolt 100 includes two sidewalls 116 extending substantially perpendicular from the chassis 60, a forward wall portion 120 connecting the sidewalls 116 adjacent to the latchbolt 40, and a rearward wall portion 124 (FIGS. 5 and 7) connecting the sidewalls 116 proximate the deadlock link 104. Each sidewall 116 defines two clearance slots 128, 132 to facilitate coupling the auxiliary bolt 100 to the inner housing 56. The slots 128 receive the pin 96 that couples the latchbolt link 80 to the pushbar link 84 to allow the pin 96, and thereby the latchbolt link 80 and the pushbar link 84, to move relative to the auxiliary bolt 100. As shown in FIG. 2, the inner housing 56 defines corresponding clearance slots 136 to also allow the latchbolt link 80 and the pushbar link 84 to move relative to the inner housing 56. Referring back to FIGS. 3-8, the slots 132 receive a pin 140 that couples the deadlock link 104 and the bracket 108 to the inner housing 56 to allow the pin 140, and thereby the deadlock link 104 and the bracket 108, to move relative to the auxiliary bolt 100.

The auxiliary bolt 100 is movable relative to the inner housing 56 between an extended position (FIGS. 2-5) and a retracted position (FIGS. 6-8). In the illustrated construction, the auxiliary bolt 100 translates between the extended and retracted positions by sliding along the pins 96, 140. As shown in FIGS. 5 and 7, the spring 112 engages the rearward wall portion 124 of the auxiliary bolt 100 to bias the auxiliary bolt 100 toward the extended position (to the left in the figures). When the door 24 is in the open position (FIGS. 4 and 5), the auxiliary bolt 100 is in the extended position such that the rearward wall portion 124 engages the deadlock link 104, as further discussed below. As the door 24 is closing, the strike 48 engages a ramped surface 144 on each sidewall 116 of the auxiliary bolt 100 proximate the forward wall portion 120 to push the auxiliary bolt 100 against the bias of the spring 112 to the retracted position. When the door 24 is closed (FIGS. 6 and 7), the strike 48 remains in contact with the auxiliary bolt 100 to keep the auxiliary bolt 100 in the retracted position such that the rearward wall portion 124 of the auxiliary bolt 100 is spaced apart from the deadlock link 104.

In the illustrated construction, the deadlock link 104 includes two leg portions 148 extending generally toward the chassis 60 and two arm portions 152 extending generally toward the latchbolt 40. The deadlock link 104 is rotatably coupled to the inner housing 56 by the pin 140 extending through the leg portions 148 such that the deadlock link 104 can rotate relative to the housing 56. As shown in FIGS. 5 and 7, the pin 140 defines a pivot axis 156. The deadlock link 104 also includes a post or pin 160 extending through the arm portions 152. The post 160 is configured to engage a surface 164 of the latchbolt link 80 to inhibit movement of the latchbolt 40 to the retracted position, as further described below. In other constructions, the post 160 may be replaced with other suitable ribs or projections that are configured to engage the latchbolt link 80. In further constructions, the post 160 may engage the latchbolt 40 directly to inhibit movement of the latchbolt 40 to the retracted position.

The illustrated deadlock link 104 rotates about the pivot axis 156 between a disengaged position (FIGS. 4, 5, and 8) and an engaged position (FIGS. 6 and 7). In the disengaged position, the deadlock link 104 is oriented such that the post 160 is spaced apart from the surface 164 of the latchbolt link 80, allowing the latchbolt 40 to move toward the retracted position. The deadlock link 104 is rotated about the pivot axis 156 toward the disengaged position when the door 24 is in the open position and/or the pushbar 36 is actuated (e.g., when the auxiliary bolt 100 is in the extended position and/or the pushbar link 84 is retracted). In the engaged position, the deadlock link 104 is oriented such that the post 160 contacts the surface 164 of the latchbolt link 80 (FIG. 6), inhibiting movement of the latchbolt 40 to the retracted position. The deadlock link 104 is rotated about the pivot axis 156 toward the engaged position when the door 24 is in the closed position (e.g., when the auxiliary bolt 100 is in the retracted position and the pushbar link 84 is not retracted).

Figure 9:
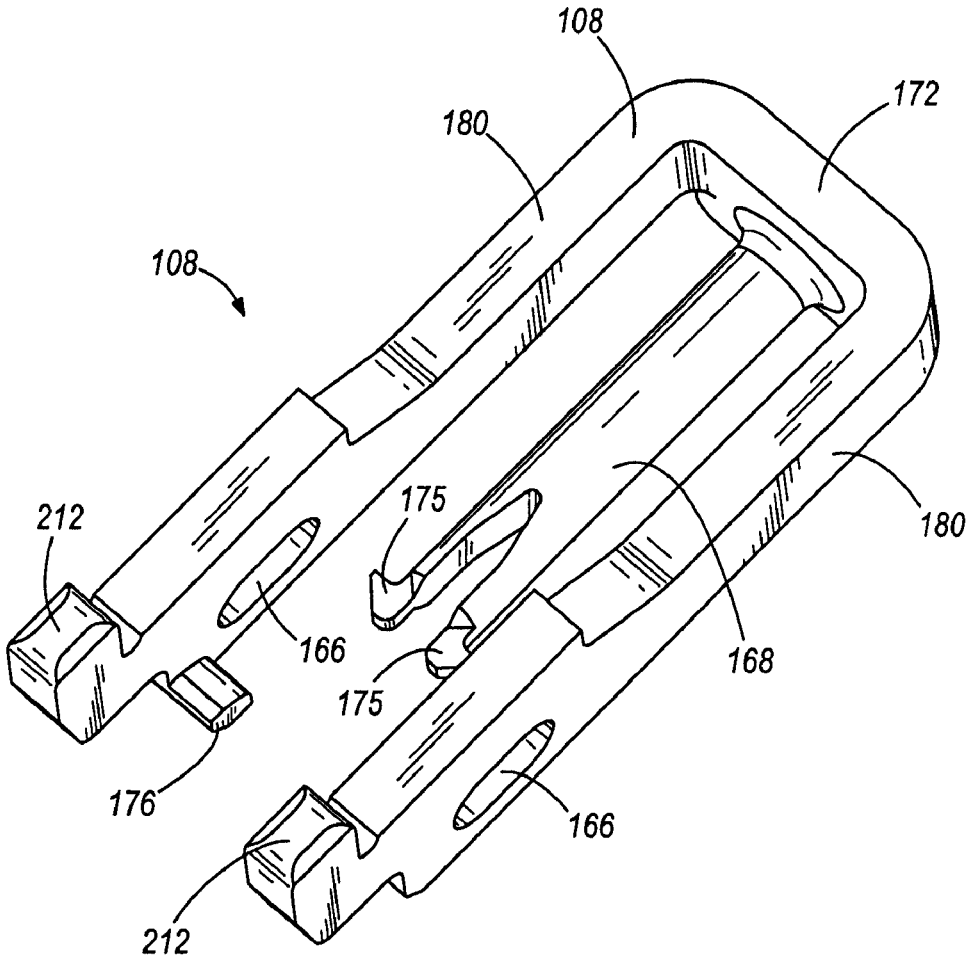
FIG. 9 is a perspective view of a bracket for use with the head mechanism.

The bracket 108 is also coupled to the inner housing 56 with the pin 140 that supports the deadlock link 104. As shown in FIGS. 5, 7, and 9, the illustrated bracket 108 includes two clearance slots 166 (FIG. 9) to receive the pin 140 and a cylindrical shaft 168 extending from a rear wall 172 of the bracket 108 through an opening 174 in the rearward wall portion 124 of the auxiliary bolt 100. The end of the shaft 168 forms two hook-shaped prongs 175 that compress together to facilitate inserting the shaft 168 through the opening 174. Once the bracket 108 is coupled to the auxiliary bolt 100, the prongs 175 engage the rearward wall portion 124 to inhibit the shaft 168 from being biased by the spring 112 completely out of the opening 174.

In the illustrated construction, the bracket 108 also includes two ribs 176 (only one of which is shown) extending inwardly from opposing sidewalls of the bracket 108 toward the shaft 168. Each rib 176 engages the corresponding leg portion 148 of the deadlock link 104, as further described below. In some constructions, the bracket 108 may include a single rib that only engages one leg portion 148 of the deadlock link 104. In other constructions, the bracket may include a single post or member extending between the sidewalls 180 of the bracket 108 to engage both leg portions 148 of the deadlock link 104.

The spring 112 is positioned about the shaft 168 between the rear wall 172 of the bracket 108 and the rearward wall portion 124 of the auxiliary bolt 100. In the illustrated construction, the spring 112 biases the auxiliary bolt 100 toward the extended position and biases the bracket 108 away from the latchbolt 40. Referring to FIG. 5, the rearward wall portion 124 of the auxiliary bolt 100 engages the leg portions 148 of the deadlock link 104 along a first edge 184, while the ribs 176 of the bracket 108 engage the leg portions 148 of the deadlock link 104 along a second edge 188. Since both the auxiliary bolt 100 and the bracket 108 are biased by the spring 112, the force provided by the rearward portion 124 and the force provided by the ribs 176 against the leg portions 148 are substantially equal, although on opposite edges 184, 188 of the leg portions 148. In the illustrated construction, the auxiliary bolt 100 contacts the leg portions 148 of the deadlock link 104 at a first distance A from the pivot axis 156 and the bracket 108 contacts the leg portions 148 of the deadlock link 104 at a second distance B from the pivot axis 156. The first distance A is substantially larger than the second distance B such that, when both the auxiliary bolt 100 and the bracket 108 are contacting the deadlock link 104, the deadlock link 104 is rotated (clockwise in FIG. 5) by the auxiliary bolt 100 to the disengaged position.

Referring to FIG. 7, when the auxiliary bolt 100 is moved to the retracted position (e.g., when the door 24 is in the closed position), the rearward wall portion 124 of the auxiliary bolt 100 is spaced apart from the deadlock link 104. In this position, only the ribs 176 of the bracket 108 contact the deadlock link 104. The deadlock link 104 is thereby rotated by the bracket 108 in an opposite direction (counterclockwise in FIG. 7) about the pivot axis 156 to the engaged position.

As shown in FIGS. 4 and 5, the door 24 is in the open position so that the latchbolt 40 and the auxiliary bolt 100 are in their extended positions. In this position, both the rearward wall portion 124 of the auxiliary bolt 100 and the ribs 176 of the bracket 108 engage the leg portions 148 of the deadlock link 104, rotating the deadlock link 104 to the disengaged position. The post 160 of the deadlock link 104 is thereby spaced apart from the surface 164 of the latchbolt link 80 such that the latchbolt 40 is movable to the retracted position. When the strike 48 contacts the planar surface 72 of the latchbolt 40 and the ramped surfaces 144 of the auxiliary bolt, the latchbolt 40 and the auxiliary bolt 100 move to their retracted positions to clear the strike 48, allowing the door 24 to rotate to the closed position.

As shown in FIGS. 6 and 7, the door 24 is in the closed position so that the latchbolt 40 is in the extended position and the auxiliary bolt 100 is in the retracted position. In this position, the rearward wall portion 124 of the auxiliary bolt 100 is spaced apart from the leg portions 148 of the deadlock link 104 so that only the ribs 176 of the bracket 108 engage the deadlock link 104. The deadlock link 104 is rotated about the pivot axis 156 to the engaged position. In the engaged position, the post 160 of the deadlock link 104 contacts the surface 164 of the latchbolt link 80 to inhibit movement of the latchbolt 40 toward the retracted position, thereby retaining the door 24 in the closed position.

In the illustrated construction, the spring 112 is further compressed between the rearward portion 124 of the auxiliary bolt 100 and the rear wall 172 of the bracket 108 when the auxiliary bolt 100 is in the retracted position. The biasing force provided by the spring 112 between the ribs 176 of the bracket 108 and the leg portions 148 of the deadlock link 104 is therefore increased. As such, the amount of force holding the deadlock link 104 in the engaged position is increased. If the auxiliary bolt 100 is further retracted (e.g., due to tampering with the auxiliary bolt 100), the spring 112 will be even further compressed, increasing the biasing force provided by the spring 112 and, thereby, increasing the amount of force holding the deadlock link 104 in the engaged position.

When the door is in the closed position, the deadlock link 104 is moved from the engaged position to the disengaged position by actuating the pushbar 36. Actuating the pushbar moves the pushbar link 84 from the position shown in FIGS. 6 and 7 to the position shown in FIG. 8. As the pushbar link 84 slides away from the latchbolt 40 (to the right in FIGS. 6-8), ramped surfaces 192 of the pushbar link 84 contact the post 160 of the deadlock link 104. The pushbar link 84 lifts the post 160 away from the latchbolt link 84 (i.e., from the position shown in FIGS. 6 and 7), rotating the deadlock link 104 about the pivot axis 156 to the disengaged position (i.e., to the position shown in FIG. 8) against the biasing force provided by the spring 112. The post 160 is thereby moved out of the way of the surface 164 of the latchbolt link 80.

At substantially the same time, the pushbar link 84 pulls the latchbolt link 80, which pulls the latchbolt 40 to the retracted position. Since the post 160 of the deadlock link 104 is no longer engaging the surface 164 of the latchbolt link 80, the latchbolt 40 can retract far enough to clear the strike 48, allowing the door 24 to rotate to the open position. Once the latchbolt 40 is clear of the strike 48 and the pushbar 36 is released, the latchbolt 40 and the auxiliary bolt 100 return to their extended positions (FIGS. 4 and 5) such that the auxiliary bolt 100 holds the deadlock link 104 in the disengaged position until the door 24 is closed again.

Figure 10:
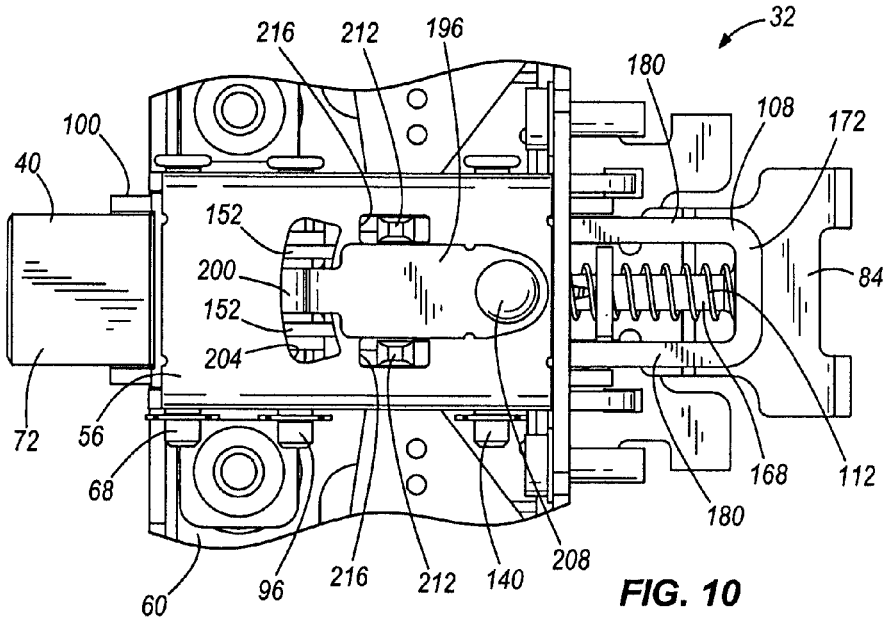
FIG. 10 is a front view of a portion of the head mechanism shown in FIG. 2 including a firedog link spaced apart from a deadlock link.
Figure 11:
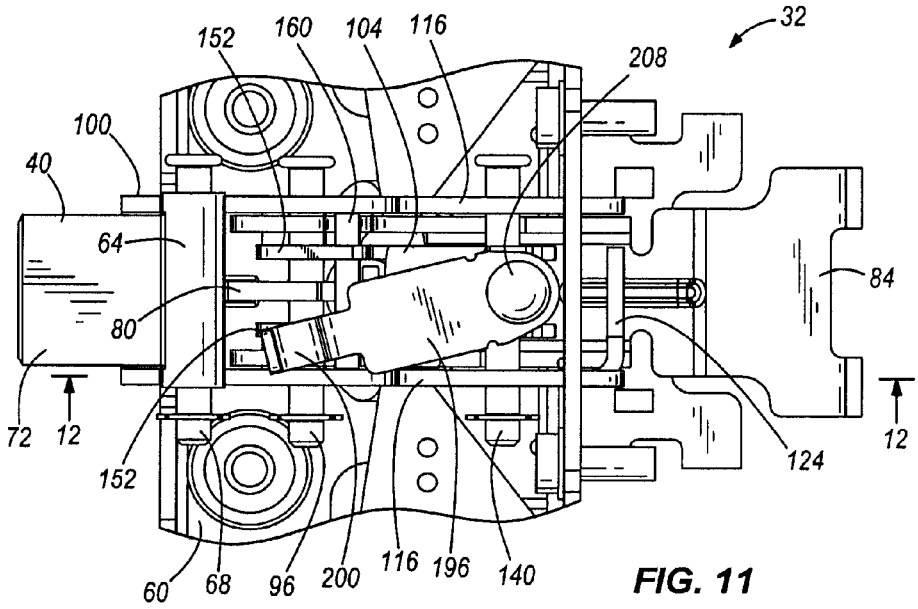
FIG. 11 is a front view of the portion of the head mechanism shown in FIG. 10 without the inner housing and with the firedog link engaging the deadlock link.
Figure 12:
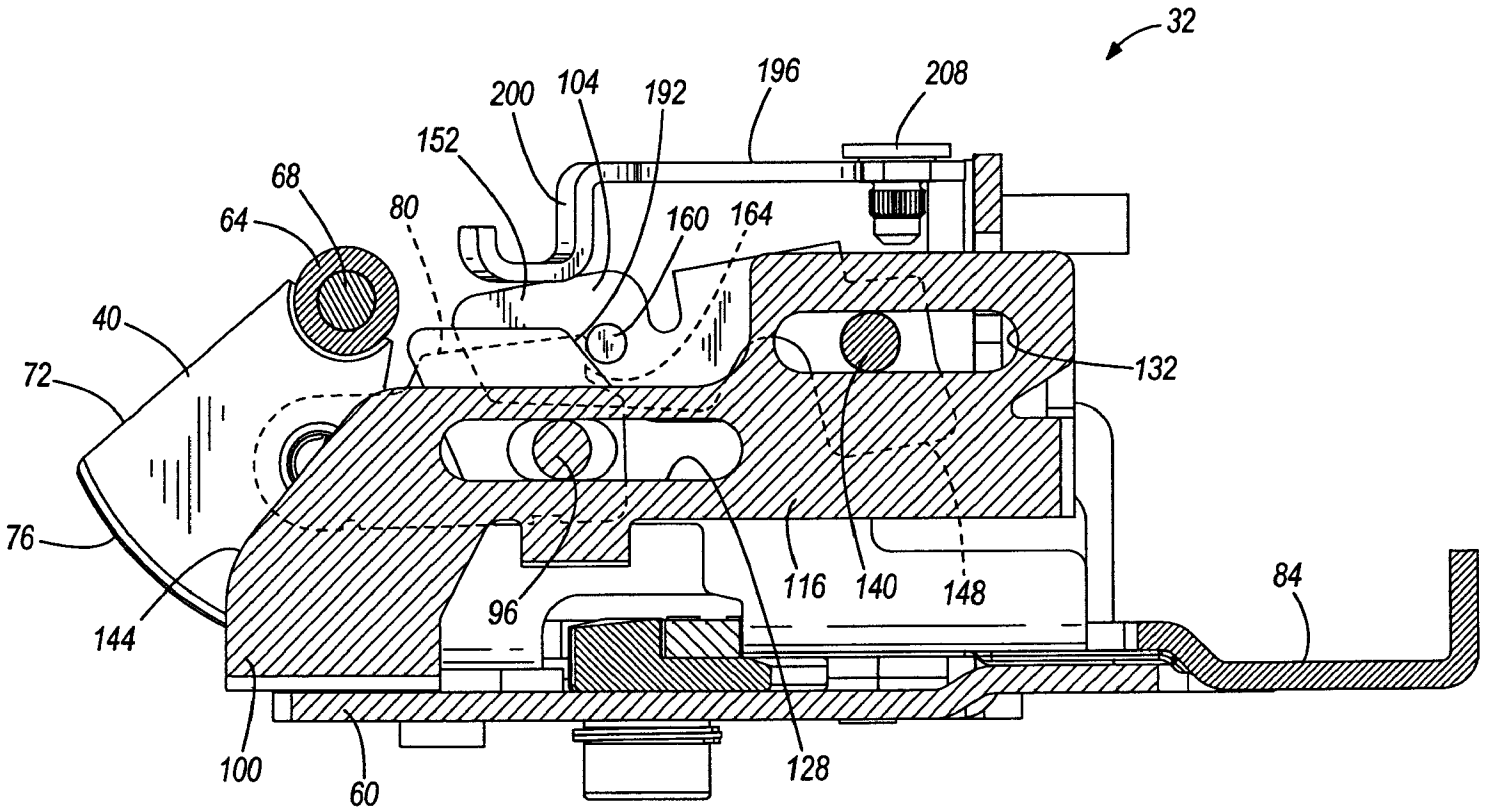
FIG. 12 is a cross-sectional view of the portion of the head mechanism taken along section line 12-12 of FIG. 11.

As shown in FIGS. 2-12, the head mechanism 32 also includes a firedog link 196 to help prevent the door 24 from being opened in the event of a fire. The illustrated firedog link 196 is coupled to the inner housing 56 and supported by the bracket 108, as further explained below. The firedog link 196 includes a hooked portion 200 extending through an arcuate slot 204 in the inner housing 56. A fastener 208 couples the firedog link 196 to the inner housing 56. In the illustrated construction, the fastener 208 rotatably couples the firedog link 196 to the inner housing 56 so that the firedog link 196 can rotate from an unlocked position (FIG. 10) to a locked position (FIGS. 11 and 12). In FIGS. 10 and 11, the head mechanism 32 is shown in elevation, or as it would be mounted on a vertical door, such that gravity biases the firedog link 196 to rotate about the fastener 208 in a counterclockwise direction. When in the unlocked position, the hooked portion 200 of the firedog link 196 is positioned between the arm portions 152 of the deadlock link 104, allowing the deadlock link 104 to rotate between the engaged and disengaged positions without interference from the firedog link 196. When in the locked position, the hooked portion 200 contacts one of the arm portions 152 of the deadlock link 104, preventing rotation of the deadlock link 104 from the engaged position to the disengaged position. In other constructions, the firedog link 196 may be slidably coupled to the inner housing 56 using suitable coupling means so that the firedog link 196 slides from the unlocked position to the locked position.

As shown in FIGS. 2 and 10, the bracket 108 includes two projections 212 extending through corresponding openings 216 in the inner housing 56 adjacent to the firedog link 196. The projections 212 support the firedog link 196 in the unlocked position so that the hooked portion 200 does not engage and prevent movement of the deadlock link 104. In the illustrated construction, the bracket 108 is composed of a nylon material such that the bracket 108 melts at relatively high temperatures (e.g., during a fire). In other constructions, the bracket 180 may be composed of other fusible materials.

As shown in FIGS. 11 and 12, when the bracket 108 melts, the firedog link 196 is no longer supported by the projections 212. The firedog link 196 thereby rotates to the locked position such that the hooked portion 200 of the firedog link 196 slides within the arcuate slot 204 to engage one of the arm portions 152 of the deadlock link 104. In the illustrated construction, the firedog link 196 is rotated by gravity, although in other constructions, a spring may be positioned about the fastener 208 to bias the firedog link 196 to the locked position. When in the locked position, the firedog link 196 prevents the deadlock link 104 from moving to the disengaged position (even if a user actuates the pushbar 36) to retain the door 24 in the closed position during a fire.

Various features and advantages of the invention are set forth in the following claims.

What is claimed is:

1. An exit device comprising:

a housing;

a latchbolt coupled to and movable relative to the housing;

an auxiliary bolt coupled to the housing and movable relative to the latchbolt;

a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing;

a spring biasing the auxiliary bolt into engagement with a portion of the deadlock link to move the deadlock link toward the first position; and a bracket coupled to the auxiliary bolt and the deadlock link, wherein the spring biases the bracket into engagement with a portion of the deadlock link to move the deadlock link toward the second position.

2. The exit device of claim 1, wherein the spring provides the only biasing force to move the deadlock link between the first and second positions.

3. The exit device of claim 1, wherein the bracket includes a shaft extending through an opening in the auxiliary bolt, and wherein the spring is positioned about at least a portion of the shaft between the auxiliary bolt and the bracket.

4. The exit device of claim 1, wherein the spring biases the auxiliary bolt and the bracket into engagement with the deadlock link simultaneously.

5. The exit device of claim 4, wherein the deadlock link is rotatably coupled to the housing to rotate about an axis between the first position and the second position, wherein the auxiliary bolt engages the deadlock link at a first distance from the axis and the bracket engages the deadlock link at a second distance from the axis, and wherein the first distance is substantially greater than the second distance such that the deadlock link rotates to the first position when both the auxiliary bolt and the bracket engage the deadlock link.

6. The exit device of claim 5, wherein the auxiliary bolt is movable against the bias of the spring to disengage the deadlock link such that only the bracket engages the deadlock link to rotate the deadlock link to the second position.

7. The exit device of claim 1, further comprising a firedog link coupled to the housing and supported by the bracket, wherein the bracket is configured to melt at relatively high temperatures, and wherein, when the bracket melts, the firedog link moves relative to the deadlock link to inhibit movement of the deadlock link from the second position to the first position.

8. The exit device of claim 1, wherein the spring biases the auxiliary bolt to an extended position relative to the housing, and wherein the auxiliary bolt is movable against the bias of the spring to a retracted position relative to the housing.

9. The exit device of claim 8, wherein the auxiliary bolt engages the deadlock link to move the deadlock link to the first position when in the extended position and disengages the deadlock link to allow movement of the deadlock link to the second position when in the retracted position.

10. The exit device of claim 1, further comprising a pushbar coupled to the latchbolt, wherein the pushbar is actuable to move the latchbolt to a retracted position relative to the housing.

11. An exit device comprising:

a housing;

a latchbolt coupled to and movable relative to the housing;

an auxiliary bolt coupled to the housing and movable relative to the latchbolt;

a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing;

a bracket engaging a portion of the deadlock link to move the deadlock link toward the second position, the bracket configured to melt at relatively high temperatures; and a firedog link supported by the bracket such that, when the bracket melts, the firedog link moves relative to the deadlock link to inhibit movement of the deadlock link from the second position to the first position.

12. The exit device of claim 11, wherein the firedog link is rotatably coupled to the housing about an axis, and wherein the firedog link rotates about the axis relative to the housing and the deadlock link when the bracket melts.

13. The exit device of claim 11, wherein the bracket is composed of a nylon material.

14. The exit device of claim 11, further comprising a spring positioned between the auxiliary bolt and the bracket, wherein the spring biases the auxiliary bolt into engagement with a portion of the deadlock link to move the deadlock link toward the first position and biases the bracket into engagement with another portion of the deadlock link to move the deadlock link toward the second position.

15. The exit device of claim 14, wherein the bracket includes a shaft extending through an opening in the auxiliary bolt, and wherein the spring is positioned about at least a portion of the shaft between the auxiliary bolt and the bracket.

16. The exit device of claim 15, wherein the shaft of the bracket includes two hook-shaped prongs positioned within the opening in the auxiliary bolt, and wherein the hook-shaped prongs are compressible together to facilitate coupling the bracket to the auxiliary bolt.

17. The exit device of claim 14, wherein the spring biases the auxiliary bolt and the bracket into engagement with the deadlock link simultaneously.

18. The exit device of claim 17, wherein the deadlock link is rotatably coupled to the housing to rotate about an axis between the first position and the second position, wherein the auxiliary bolt engages the deadlock link at a first distance from the axis and the bracket engages the deadlock link at a second distance from the axis, and wherein the first distance is substantially greater than the second distance such that the deadlock link rotates to the first position when both the auxiliary bolt and the bracket engage the deadlock link.

19. The exit device of claim 11, further comprising a pushbar coupled to the latchbolt, wherein the pushbar is actuable to move the latchbolt to a retracted position relative to the housing.

20. An exit device comprising:

a housing;

a latchbolt coupled to and movable relative to the housing;

a pushbar coupled to the latchbolt, the pushbar actuable to move the latchbolt to a retracted position relative to the housing;

an auxiliary bolt coupled to the housing and movable relative to the latchbolt;

a deadlock link coupled to the housing and movable relative to the latchbolt and the auxiliary bolt between a first position, in which the deadlock link allows movement of the latchbolt relative to the housing, and a second position, in which the deadlock link inhibits movement of the latchbolt relative to the housing;

a bracket coupled to the auxiliary bolt and the deadlock link, the bracket configured to melt at relatively high temperatures;

a spring positioned between the auxiliary bolt and the bracket, the spring biasing the auxiliary bolt into engagement with a portion of the deadlock link to move the deadlock link toward the first position and biasing the bracket into engagement with another portion of the deadlock link to move the deadlock link toward the second position; and a firedog link supported by the bracket such that, when the bracket melts, the firedog link moves relative to the deadlock link to inhibit movement of the deadlock link from the second position to the first position.

21. The exit device of claim 20, wherein the deadlock link is rotatably coupled to the housing to rotate about an axis between the first position and the second position, wherein the auxiliary bolt engages the deadlock link at a first distance from the axis and the bracket engages the deadlock link at a second distance from the axis, and wherein the first distance is substantially greater than the second distance such that the deadlock link rotates to the first position when both the auxiliary bolt and the bracket engage the deadlock link.

22. The exit device of claim 20, wherein the spring biases the auxiliary bolt to an extended position relative to the housing, wherein the auxiliary bolt is movable against the bias of the spring to a retracted position relative to the housing, and wherein the auxiliary bolt engages the deadlock link to move the deadlock link to the first position when in the extended position and disengages the deadlock link to allow movement of the deadlock link to the second position when in the retracted position.

23. The exit device of claim 20, wherein the firedog link is rotatably coupled to the housing about an axis, and wherein the firedog link rotates about the axis relative to the housing and the deadlock link when the bracket melts.

24. The exit device of claim 20, wherein the bracket is composed of a nylon material.

* * * * *